US008151524B2

(12) United States Patent
Daddio

(10) Patent No.: US 8,151,524 B2
(45) Date of Patent: Apr. 10, 2012

(54) VENTED CLOSURE FOR METAL ROOF

(76) Inventor: Vincent P. Daddio, Stephenville, TX (US)

( * ) Notice: Subject to any disclaimer, the term of this patent is extended or adjusted under 35 U.S.C. 154(b) by 0 days.

(21) Appl. No.: 13/182,640

(22) Filed: Jul. 14, 2011

(65) Prior Publication Data

US 2011/0308178 A1 Dec. 22, 2011

(51) Int. Cl.
*E04B 7/00* (2006.01)

(52) U.S. Cl. ..... 52/199; 52/198; 52/302.1; 454/365

(58) Field of Classification Search ..... 52/198, 52/199, 302.1; 454/365
See application file for complete search history.

(56) References Cited

U.S. PATENT DOCUMENTS

| | | | | |
|---|---|---|---|---|
| 3,073,235 | A * | 1/1963 | Randall et al. | 454/250 |
| 3,185,070 | A * | 5/1965 | Smith | 454/365 |
| 4,685,265 | A * | 8/1987 | Cooper | 52/277 |
| 4,817,506 | A | 4/1989 | Cashman | |
| 5,022,203 | A | 6/1991 | Boyd | |
| 5,092,225 | A | 3/1992 | Sells | |
| 5,212,913 | A * | 5/1993 | Whitehead | 52/57 |
| 5,339,582 | A | 8/1994 | Sells | |
| 5,352,154 | A | 10/1994 | Rotter et al. | |
| 5,427,571 | A | 6/1995 | Sells | |
| 5,542,882 | A | 8/1996 | Sells | |
| 5,603,657 | A | 2/1997 | Sells | |
| 5,704,834 | A | 1/1998 | Sells | |
| 5,921,863 | A | 7/1999 | Sells | |
| 6,267,668 | B1 | 7/2001 | Morris | |
| 6,401,412 | B1 | 6/2002 | Cooper | |
| 6,450,882 | B1 | 9/2002 | Morris et al. | |
| 6,558,251 | B2 | 5/2003 | Sells | |
| 6,913,530 | B2 | 7/2005 | Morris et al. | |
| 7,594,363 | B2 | 9/2009 | Polumbus et al. | |

OTHER PUBLICATIONS

"Product and Engineering Manual, 8.0 Accessories", Nucor Building Systems, Oct. 2009, 8 pages.
"COR-A-VENT . . . The Solution for Venting Today's Metal Roofs", COR-A-VENT, Inc., 2005, 4 pages.
"Ridge Vent Considerations for Architectural Metal Roofing", Berridge Manufacturing Company, Published at least as early as Feb. 2008, 1 page.

* cited by examiner

*Primary Examiner* — Robert Canfield
*Assistant Examiner* — Matthew Gitlin
(74) *Attorney, Agent, or Firm* — Cahill Glazer PLC

(57) ABSTRACT

A vented ridge closure for covering a ventilation gap formed in the metal roof of a building includes U-shaped deck caps extending over the uppermost ends of the roof deck panels. The deck caps close-off the valleys of the roof deck panels, while providing air flow openings for directing hot air to the exterior. The air flow openings may be louvered. A ridge cap extending along the ridge of the roof above the ventilation gap. Side flanges of the ridge cap engage top panels of the deck caps, and are secured by fasteners to ribs of the underlying roof deck panels, or by inwardly-turned lips to the peripheral edges of the deck caps. Sealing material is preferably provided between a central panel of each deck cap and the abutting uppermost ends of the roof deck panels engaged therewith.

27 Claims, 2 Drawing Sheets

VENTED CLOSURE FOR METAL ROOF

BACKGROUND OF THE INVENTION

1. Field of the Invention

The present invention relates generally to metal roof buildings having a central peak or ridge, and more particularly, to a vented closure system for venting hot air from the central peaks of such roofs while precluding wind-blown rain water from entering such roofs.

2. Description of the Relevant Art

Metal roofing has been used to cover buildings for many years. One common type of metal roofing is typically formed by ribbed steel deck panels supported upon purlins. An attic floor can be formed below the metal roof, in some cases; in other case, for example, farm buildings or warehouses, there may not be an enclosed attic separating the work space below from the metal roof.

When constructing metal roofs, the edges of adjacent metal roof deck panels are overlapped with each other to form a continuous sheet of roofing. Steel roof deck panels can easily be transported to a work site and are relatively simple to install. Metal roofs have a great number of advantages, including relatively high strength-to-weight ratios, long life, fire resistance, weather resistance (including resistance to hail damage), competitive material cost compared to other roofing options, and relatively low installation costs.

On the other hand, metal roofs, and metal buildings in general, tend to absorb heat from the sun during summer months. Reflective coatings, radiant barriers and/or insulation are sometimes added to such metal roof structures to improve energy-efficiency. Alternatively, for building spaces that are not air-conditioned, such as commercial warehouses, farm buildings, or enclosed attic spaces, it is known to form a ventilation gap along the ridge of the metal roof. The ventilation gap allows hot air, that would otherwise be trapped below the roof, to rise toward the ridge of the roof and escape to the exterior of the building. Of course, providing a vent along the ridge of the roof introduces another problem, namely, sealing the vent gap against the entry of rain and snow. In particular, buildings located in windy areas are often subject to wind-blown rain that, at times, is driven virtually horizontally along the roof.

Those skilled in the art have long attempted to solve the problem of effectively venting hot air from metal roof buildings through roof ridge vents while sealing out wind-blown moisture. For example, U.S. Pat. No. 5,022,203 to Boyd discloses a ridge vent structure for a metal roof. The roof structure includes wooden substrates below the steel roof panels, and further includes a pair of central wooden battens secured to such substrates along opposing sides of the ridge. The ridge vent includes a corrugated sheet secured to each of the wooden battens, a flat plate overlying each corrugated sheet, and a ridge cap extending thereabove. All of the aforementioned components are in addition to the metal roof panels that actually form the roof. Hot air escapes through gaps above and below each of the corrugated sheets.

U.S. Pat. No. 5,092,225 to Sells discloses a wooden roof structure that includes a vented ridge cap using a corrugated metal baffle member having holes formed therein for allowing hot air to escape from the roof through such holes.

U.S. Pat. No. 5,352,154 to Rotter, et al. discloses a metal roof ventilation system for placement along the ridge of the roof. Air permeable venting material is secured to the upper edges of metal roof panels by clips proximate to the peak of the roof, and ridge caps extend over the air permeable material and around the clips.

U.S. Pat. No. 5,704,834 to Sells describes a moisture resistant roof vent in which an air permeable, moisture repelling fabric covers the sides of the vent passages to try to prevent wind-driven rain from being blown into the ridge vent, and into the underlying building.

U.S. Pat. No. 5,921,863 to Sells discloses a wide variety of roof ventilating structures using a number of different baffles or louvers to form a vent path for hot air. The louvers are formed within essentially vertically-oriented members, causing the ridge cap to have a relatively tall profile.

U.S. Pat. No. 6,267,668 to Morris also discloses a ridge cap vent for metal roof systems. One or more corrugated layers are installed between the peak of the roof and the ridge cap, while closure strips are installed below each corrugated layer and the underlying metal roof panels. Hot air escapes through the paths formed along the corrugations of the corrugated layers.

Also, U.S. Pat. No. 7,594,363 to Polumbus discloses a ridge vent system for sloped metal roofs wherein an air-permeable sealing strip is secured to the roof panels near the ridge, and a ridge cap extends over the sealing strip.

While each of the aforementioned prior art roof ridge vents may offer benefits in particular applications, there is still a need for an efficient, inexpensive, and simple ridge roof vent for use with common metal panel roofs. For example, some of the roof vents shown in the prior art require specialized air-permeable membranes to resist the entry of moisture; apart from adding cost, such air-permeable membranes also restrict air flow to some extent. In addition, such air permeable membranes tend to shrink and deteriorate over time due to alternating cycles of heat and cold. After shrinking, such membranes often fall out of the ridge vent structure, allowing wind-blown rain to enter into the ridge vent.

Some of the vent structures described above require alteration of the normal procedures for installing metal roofs, as, for example, requiring support substrates or battens near the ridge of the roof. Still other roof vent structures shown in the prior art create air flow paths by spacing the side edges of the ridge cap above the upper plane of the metal roof panels, thereby complicating the attachment of the ridge cap to the underlying roof. Further, some of the prior art vent structures described in the patents referenced above require relatively tall baffles, thereby necessitating the use of higher profile ridge caps; in general, it is preferred to use ridge caps that do not form easily noticeable discontinuities in the roof line. In addition, apart from efficiently venting the roof of hot air and resisting entry of wind-blown rain, an ideal roof vent must also be relatively inexpensive, of simple construction, and easy to install.

Accordingly, it is an object of the present invention to provide a simple and inexpensive roof ridge vent to cover the ridge of a metal-roofed building while efficiently venting hot air from below the roof to the exterior.

It is a another object of the present invention to provide such a roof ridge vent that effectively resists moisture penetration, as from wind-blown rain.

It is still another object of the present invention to provide such a roof ridge vent that may readily be used with almost all conventional sloped metal roof decking panel designs.

It is a still further object of the present invention to provide such a roof ridge vent that does not require modification of techniques already used to construct metal roofs having a ventilation slot along the ridge of the roof.

Still another object of the present invention is to provide such a roof ridge vent that avoids the need for water-resistant membranes or fabrics that would otherwise lessen the rate of air flow.

Yet another object of the present invention is to provide such a roof ridge vent that permits the side edges of the ridge cap to be securely coupled to the underlying metal roof panels.

A still further object of the present invention is to provide such a roof ridge vent that allows for the use of a relatively low profile ridge cap to cover the vent along the ridge of the roof.

These and other objects of the invention will become more apparent to those skilled in the art as the description of the present invention proceeds.

SUMMARY OF THE INVENTION

Briefly described, and in accordance with a preferred embodiment of the present invention, a vented closure is provided for a metal roof of a building. The metal roof with which such vented closure is used includes a series of corrugated metal roof panels extending upwardly toward the central peak of the roof. Each corrugated metal roof panel has a plurality of raised ribs and a plurality of trough-like valley extending generally upwardly toward the central peak. The uppermost ends of the metal roof panels located closest to the central peak on one side thereof are spaced apart from the uppermost ends of the metal roof panels located on the opposite side thereof to form a ventilation gap therebetween.

The vented closure itself includes a first U-shaped deck cap extending over and around the uppermost end of the metal roof panels located closest to the central peak on a first side thereof. The first deck cap includes a top panel extending over the uppermost end of such metal roof panels, a bottom panel extending under the uppermost end of such metal roof panels, and a central panel connecting the top and bottom panels to each other. This central panel of the first deck cap also closes the trough-like valleys of such metal roof panels proximate the central peak. The top panel of the first deck cap has a first set of openings formed therein.

The vented closure further includes a second U-shaped deck cap having a structure similar to the first deck cap, and extending over and around the uppermost end of the metal roof panels located closest to the central peak on the second side thereof. The second deck cap includes a top panel extending over the uppermost ends of such metal roof panels on the second side of the central peak, a bottom panel extending under the uppermost ends of such metal roof panels, and a central panel connecting the top and bottom panels to each other. This central panel of the second deck cap also closes the trough-like valleys of such metal roof panels. The top panel of the second deck cap has a second set of openings formed therein.

The vented closure further includes a ridge cap extending along the central peak and above the ventilation gap. The ridge cap has first and second side flanges extending along opposing sides thereof. The first side flange engages the top panel of the first deck cap at a point beyond the first set of openings relative to the central peak. Likewise, the second side flange engages the top panel of the second deck cap at a point beyond the second set of openings relative to the central peak. In one preferred embodiment, the first side flange of the ridge cap and the top panel of the first deck cap are secured by fasteners to ribs of the metal roof panels therebelow; and similarly, the second side flange of the ridge cap and the top panel of the second deck cap are secured by fasteners to ribs of metal roof panels therebelow.

In an alternate embodiment, fasteners secure the top panels of the first and second deck caps to ribs of the metal roof panels below. The first and second side flanges of the ridge cap include inwardly-turned lips for extending around and below the top panels of the deck caps; these lips help to secure the ridge cap to the underlying deck caps.

In either case, the ridge cap closes the ventilation gap from above, but still allows air to pass upwardly through the ventilation gap, downwardly through the first and second sets of openings, and outwardly through the plurality of trough-like valleys in the metal roof panels to the exterior of the building.

In the preferred embodiment, the first and second sets of openings formed in the top panels of the first and second deck caps, respectively, are slotted louvers. Though not required, the slotted louvers are preferably arranged in a series of rows, wherein the louvers in one row are staggered relative to the louvers in an adjacent row. This staggered relationship of the louvers helps maximize the number of places where fasteners can be placed to secure the deck caps to the underlying metal roof panels.

To improve resistance to penetration by wind-blown rain, sealing material is preferably provided between the central panel of each deck cap and the uppermost end of each metal roof panel engaged with such deck cap. Such sealing material may include, for example, caulk or a layer of elastomeric material placed between the central panel of each deck cap and the uppermost ends of the metal roof panels engaged with such deck cap. The elastomeric material may be a closed cell foam tape adhered to the central panel of each deck cap before such deck caps are installed over the metal roof panels.

The present invention also relates to a vented metal roof structure for a building which includes the novel vented closure described above. The vented metal roof structure includes a first series of corrugated metal roof panels extending upwardly toward the central peak of the roof on one side thereof, and a second series of corrugated metal roof panels extending upwardly toward the central peak of the roof on the opposite side thereof. Each corrugated metal roof panel has a number of raised ribs and a number of trough-like valleys extending generally upwardly toward the central peak. The uppermost ends of the metal roof panels located closest to the central peak on one side thereof are spaced apart from the uppermost ends of the metal roof panels located on the opposite side thereof to form a ventilation gap therebetween.

A first U-shaped deck cap extends over and around the uppermost ends of the first series of metal roof panels located closest to the central peak, and a second U-shaped deck cap extends over and around the uppermost ends of the second series of metal roof panels located closest to the central peak. Each of the first and second deck caps includes a top panel that extends over the uppermost end of such metal roof panels, a bottom panel extending under the uppermost end of such metal roof panels, and a central panel connecting the top and bottom panels to each other. The deck caps close the trough-like valleys of such metal roof panels proximate the central peak. The top panel of the first deck cap has a first set of openings formed therein; likewise, the top panel of the second deck cap has a second set of openings formed therein.

The vented metal roof structure further includes a ridge cap extending along the central peak and above the ventilation gap. The ridge cap has first and second side flanges extending along opposing sides thereof. The first side flange engages the top panel of the first deck cap at a point beyond the first set of openings relative to the central peak. Likewise, the second side flange engages the top panel of the second deck cap at a point beyond the second set of openings relative to the central peak.

In one preferred embodiment of the vented metal roof structure, the first side flange of the ridge cap and the top panel of the first deck cap are secured by fasteners to ribs of the metal roof panels therebelow; and similarly, the second side flange of the ridge cap and the top panel of the second deck cap are secured by fasteners to ribs of metal roof panels therebelow.

In an alternate embodiment of the vented metal roof structure, fasteners secure the top panels of the first and second deck caps to ribs of the metal roof panels below. The first and second side flanges of the ridge cap include inwardly-turned lips for extending around and below the top panels of the deck caps; these lips help to secure the ridge cap to the underlying deck caps.

In either case, the ridge cap closes the ventilation gap in the vented metal roof structure from above, but still allows air to pass upwardly through the ventilation gap, downwardly through the first and second sets of openings, and outwardly through the plurality of trough-like valleys in the metal roof panels to the exterior of the building.

In the preferred embodiment of the vented metal roof structure, the first and second sets of openings formed in the top panels of the first and second deck caps, respectively, are slotted louvers. Though not required, the slotted louvers are preferably arranged in a series of rows, wherein the louvers in one row are staggered relative to the louvers in an adjacent row. This staggered relationship of the louvers helps maximize the number of places where fasteners can be placed to secure the deck caps to the underlying metal roof panels.

To improve resistance of the vented metal roof structure to penetration by wind-blown rain, sealing material is preferably provided between the central panel of each deck cap and the uppermost end of each metal roof panel engaged with such deck cap. Such sealing material may include, for example, caulk or a layer of elastomeric material placed between the central panel of each deck cap and the uppermost ends of the metal roof panels engaged with such deck cap. The elastomeric material may be a closed cell foam tape adhered to the central panel of each deck cap before such deck caps are installed over the metal roof panels.

DETAILED DESCRIPTION OF THE PREFERRED EMBODIMENT

Figure 1:
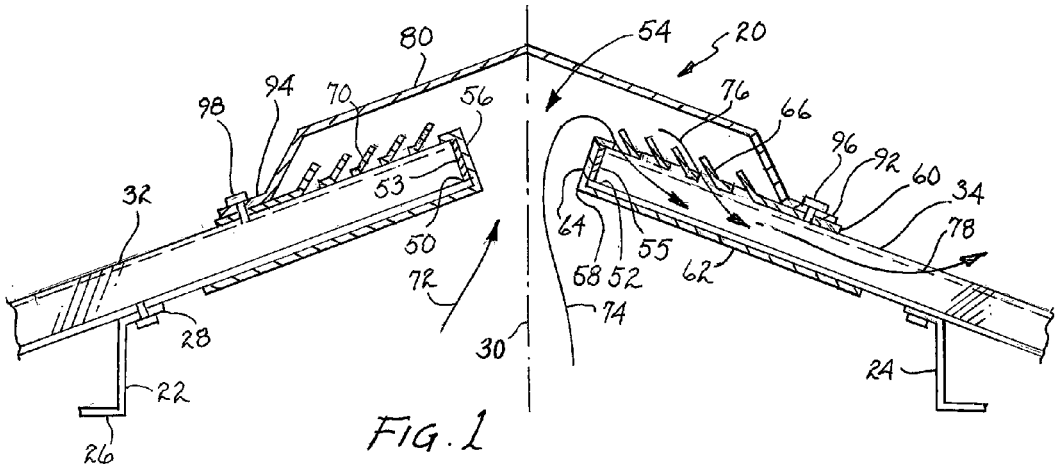
FIG. 1 is a cross-sectional view of a vented closure for a metal roof, and the resulting roof structure, in accordance with a first preferred embodiment of the present invention.

A preferred form of roof ridge vent for a metal roofed building, constructed in accordance with a preferred embodiment of the present invention, is designated generally in FIG. 1 by reference numeral 20. Roof ridge vent 20 provides a vented closure for a metal roof of a building. The building itself is not shown in the patent drawings in order to focus upon, and clarify, the specific structure of the vent and closure formed along the ridge of the roof Nonetheless, those skilled in the art will understand that the building includes a conventional foundation, vertical weight-bearing standards, and side walls.

Referring to FIG. 1, horizontally-extending metal purlins 22 and 24 extend on either side of, and parallel to, the central peak, or "ridge", of the roof structure. Purlin 22 has a lower horizontal flange 26 for resting upon, and being secured to, two or more spaced horizontal support beams (not shown). These horizontal support beams may, for example, extend within, or adjacent to, sidewalls of the building, perpendicular to purlins 22 and 24. Purlin 22 also includes an upper flange 28 which preferably extends at an angle to the horizontal, commensurate with the angular slope of the roof. Purlin 24 likewise includes lower and upper flanges similar to those described for purlin 22.

Within FIG. 1, vertical dashed line 30 represents a center line passing upwardly through the ridge of the roof. The ridge of roof structure 20 is formed by a first series of ribbed metal deck panels 32 extending toward center line 30 on the left side thereof (relative to FIG. 1), and by a second series of ribbed metal deck panels 34 extending toward center line 30 on the right side thereof, defining a central peak of the roof. Metal deck panels 32 and 34 are sometimes described as being "corrugated". As shown more clearly in FIG. 2, metal deck panel 34 includes an alternating series of raised ribs 36, 38, 40 and 42, separated by a number of trough-like valleys 44, 46 and 48. Roof deck panels 32 and 34 may be steel deck panels of the type commercially available under the designations "C-deck", "R-deck", "B-deck", "D-deck", or "N-deck", for example. Such deck panel types vary in the width and spacing of the ribs, and the depth of the valleys, but all of such types may be used in conjunction with the present invention. Such deck panels are usually provided with a galvanized finish and may include a priming coat of paint.

Roof deck panels 32 and 34 are oriented so that the ribs and valleys of each such panel extend perpendicular to the ridge line of the roof of the building, with the ribs and valleys of each metal roof panel extending generally upwardly toward the central peak. The upper end of deck panel 32 is designated within FIG. 1 by reference numeral 50, while the upper end of deck panel 34 is designated within FIGS. 1 and 2 by reference numeral 52. The upper end 50 of deck panel 32 and the upper end 52 of deck panel 34 are spaced apart from each other at the central peak to form a ventilation gap 54.

Figure 2:
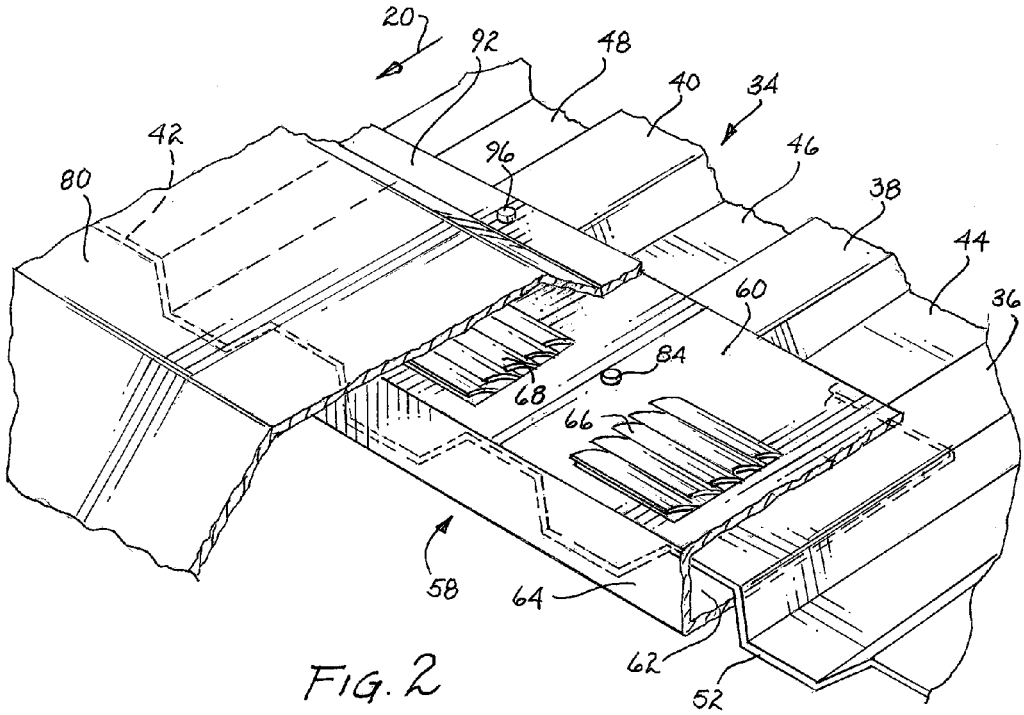
FIG. 2 is a partial perspective view of the vented closure, and roof structure, shown in FIG. 1.

Still referring to FIGS. 1 and 2, a pair of U-shaped deck caps 56 and 58 extending over, and around, the uppermost ends 50 and 52 of metal deck panels 32 and 34, respectively. Deck caps 56 and 58 are preferably made of light gauge (e.g., 26 gauge) galvanized steel. Referring to FIGS. 1 and 2, deck cap 58 includes a top panel 60 which extends over the uppermost ends of ribs 36, 38, 40 and 42 of deck panel 34. Deck cap 58 also includes a bottom panel 62 which extends under the uppermost ends of valleys 44, 46 and 48 of deck panel 34. Further, deck cap 58 includes a central panel 64 which connects top panel 60 to bottom panel 62, and which serves to close-off the upper ends of valleys 44, 46 and 48 of deck panel 34 at the uppermost end thereof proximate the central peak. Deck cap 58 simultaneously closes-off the channels formed below the ribs along the underside of deck panel 34 at the uppermost end of deck panel 34. Deck cap 56 has a construction similar to that of deck cap 58 described above, and functions in the same manner. The width of the inner channel of deck cap 58 conforms to the height of the roof deck panels being used. For example, conventional "B-deck" roof deck panels have a height of approximately 1.5 inches, and in that instance, deck cap 58 would have its top and bottom panels spaced from each other by approximately 1.5 inches.

As shown in FIGS. 1 and 2, a series of openings are formed in top panel 60 of deck cap 58. While such openings may, in some instances, simply be apertures, or punched holes, these openings are preferably formed as angled, slotted louvers 66 and 68. Such louvers are easily formed in the light gauge deck cap by punching and deforming the metal. These louvers 66 and 68 are preferably directed upwardly, and toward center line 30 (see FIG. 1). Similar louvers 70 are preferably formed in the top panel of deck cap 56. As indicated by air flow arrows 72, 74, 76 and 78, hot air below roof panels 32 and 34 rises upwardly through ventilation gap 54. This hot air can not escape by continuing to travel upward due to the presence of a ridge cap 80, described in greater detail below. Accordingly, hot air that passes upwardly through ventilation gap 54 is re-directed downwardly through louvered openings 66, 68 and 70, and outwardly through the valleys (e.g., valleys 44, 46, and 48) in deck panels 32 and 34 to the exterior of the building (as per arrow 78 in FIG. 1).

If desired, the louvered openings formed in top panel 60 of deck cap 58 may be configured in separate banks (e.g., bank 66, bank 68, etc.), as shown in FIG. 2. The spacing between adjacent banks of louvers preferably corresponds to the spacing between the ribs of the underlying deck panel 34, and deck cap 58 is preferably positioned so that each bank of louvers is directly above one of the valleys (44, 46, 48). If desired, self-tapping fastening screws may be installed through drilled holes 84 (see FIG. 2) formed between the banks of louvers for securing deck cap 58 to the underlying ribs of deck panel 34 before ridge cap 80 is installed.

Figure 3:
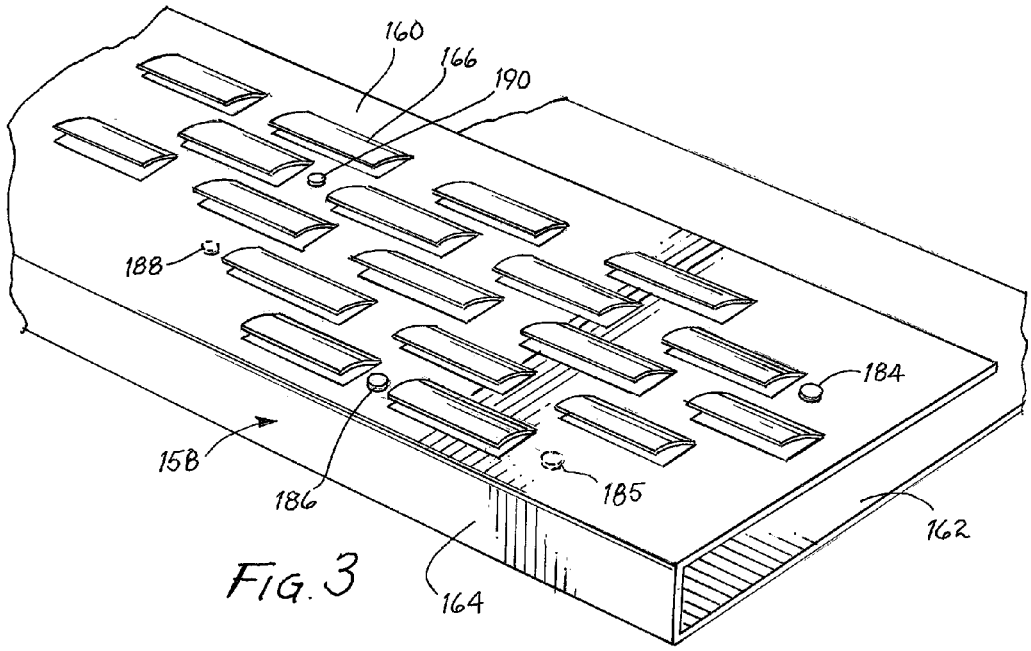
FIG. 3. is a partial perspective view of an alternate embodiment of the deck cap shown in FIGS. 1 and 2, but wherein the slotted louvers are arranged in a staggered fashion.

An alternate embodiment of the deck cap is shown in FIG. 3. Deck cap 158 of FIG. 3 again has louvered openings 166 formed within its top panel 160, but the louvered openings are provided in a continuous pattern, with the louvers in successive rows being offset, or staggered relative to each other. Reference numerals 184, 186, 188, and 190 illustrate potential locations where self-tapping screws can be inserted to secure deck cap 158 to the ribs of the deck panel (not shown in FIG. 3) surrounded by deck cap 158. By staggering the louvers, an almost infinite number of locations are provided for insertion of such fastening screws. In addition, forming the louvered openings in a continuos pattern avoids the need to align the louvers with the valleys of the deck panel below.

As mentioned above, the vented roof ridge structure includes ridge cap 80, which extends along the central peak of the roof above ventilation gap 54. Ridge cap 80 shields ventilation gap 54 from rain, snow, or debris falling upon the roof. Ridge cap 80 has the form of a shallow, inverted V-shape, and should extend at least one-two inches above louvers 66, 68, 70 for allowing air to flow freely from ventilation gap 54 into such louvers. Nonetheless, ridge cap 80 maintains a relatively low profile, and does not detract from the appearance of the ridge of the roof.

In the embodiment shown in FIGS. 1 and 2, ridge cap 80 includes first and second outwardly-directed side flanges 92 and 94 which physically support ridge cap 80 upon the roof. If desired, side flanges 92 and 94 may be secured directly to the ribs (e.g., 36, 38, 40, 42) of the underlying deck panel, as by self-tapping metal screws. Preferably, side flanges 92 and 94 overlie the outer periphery of the top panels of the deck caps at a point beyond the louvered portion at the outermost periphery of top panel 60. In this manner, fastening screw 96 can be simultaneously passed through side flange 92 of ridge cap 60, and through top panel 60 of deck cap 58, into an underlying rib (40) of roof deck panel 34. Similar fastening screws 98 secure side flange 94 of ridge cap 80 to deck cap 56 and roof deck panel 32. For many common roof deck panels, the spacing between ribs is approximately 12 inches, and such fastening screws can be installed at 12-inch intervals. Use of this technique potentially eliminates the need to install separate screws to fasten the top panels of the deck caps to the underlying ribs of the roof deck panels prior to installation of ridge cap 80, thereby simplifying installation, and further reducing labor costs.

Figure 4:
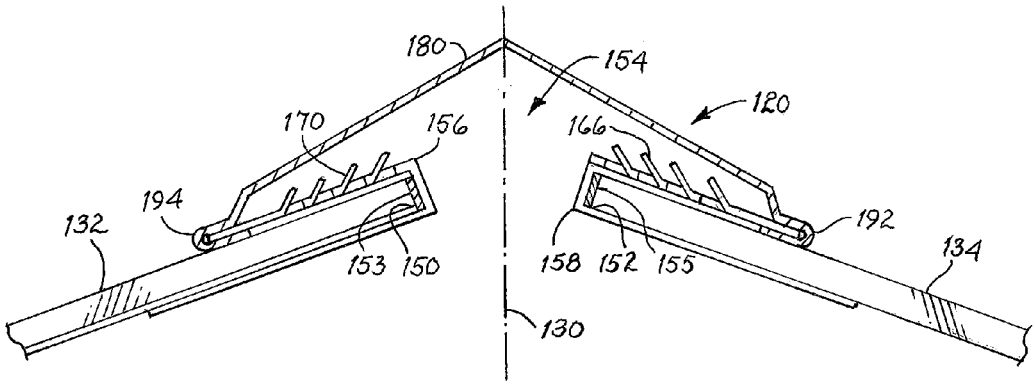
FIG. 4 is a cross-sectional view of an alternate embodiment of the vented closure, and resulting roof structure, wherein the outermost side flanges of the ridge cap include inwardly turned lips for snapping over the opposing deck caps therebelow.

FIG. 4 illustrates an alternate embodiment of the ridge cap. In FIG. 4, ridge cap 180 is similar to ridge cap 80 of FIGS. 1 and 2, except that the first and second side flanges 192 and 194 of ridge cap 180 include inwardly-turned lips that extend around and below the top panels of deck caps 158 and 156, respectively. In view of the shape and configuration of ridge cap 180, it can be temporarily flattened, as by applying downward pressure on the crown of ridge cap 180, and this causes side flanges 192 and 194 to temporarily spread apart from each other. When such downward pressure is released on ridge cap 180, side flanges 192 and 194 spring back toward one another. Therefore, if proper dimensions are followed during construction of the ridge vent, and if the spacing between the outermost edges of the top panels of deck caps 156 and 158 is properly maintained, then ridge cap 180 can simply be "snapped" over the outermost edges of deck caps 156 and 158, wherein the inwardly-turned lips of side flanges 192 and 194 engage and interlock with the outermost edges of the top panels of such deck caps. In this event, fastening screws are used to secure deck caps 156 and 158 to underlying ribs of the roof deck panels prior to installation of ridge cap 180, after which ridge cap 180 may be simply snapped over the edges of the deck caps without the further use of fasteners. This further simplifies construction and reduces installation costs.

It will be recalled that one of the objectives of the present invention is to reduce the likelihood that wind-blown rain will be able to enter the ventilation gap formed at the ridge of the roof. Applicant's deck caps effectively prevent wind-blown rain from being pushed into the building. The air flow openings formed in the top panels of the deck caps form a very indirect route by which rain water can pass into the vented ridge closure.

While the deck caps fit relatively flush against the upper ends of the roof deck panels, gaps and openings will inevitably form therebetween. Accordingly, in the preferred embodiment, a sealant 53/55 is provided at the point where the uppermost end of each roof deck panel abuts the inner wall of the central panel of each deck cap. This sealant could simply be an elastic caulk applied over the upper edges of the roof deck panel before the deck cap is engaged therewith. Preferably, the sealing material is a layer of elastomeric material, such as a closed cell foam tape, interposed between the central panel of each deck cap and the uppermost ends of the metal roof panels. This closed cell foam tape preferably includes an adhesive backing which allows it to adhered to the inside wall of the central panel of each deck cap, either at the time that such deck caps are produced, or just prior to installation; then, as each deck cap is engaged over the upper ends of its associated roof deck panels, the joint therebetween is reliably sealed without any further installation steps being required. Such closed cell, adhesive-backed foam tape is commercially available from the 3M Company of St. Paul, Minn. Preferably, such foam tape has a thickness of approximately ⅜ inch, and a width of approximately 1.25 inches.

Those skilled in the art will now appreciate that a simple and inexpensive roof ridge vent structure has been described to cover the ridge of a metal-roofed building. The disclosed roof ridge vent efficiently vents hot air from below the roof to the exterior while effectively resisting moisture penetration, as from wind-blown rain. The disclosed roof ridge vent may readily be used with almost all conventional sloped metal roof decking panel designs having a ventilation slot along the ridge of the roof. The disclosed ridge vent effectively prevents wind-blown rain from entering the ventilation gap without requiring the use of water-resistant membranes or fabrics that would otherwise lessen the rate of air flow. The ridge cap used to cover the ventilation gap is easily secured to the ridge of the roof while maintaining a relatively low profile. The disclosed ridge vent structure is not limited to buildings made entirely of metal, but can be used with virtually any structure having a roof that slopes downwardly from a ridge, such as a wood-frame structure having a pitched roof.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A vented closure for a metal roof of a building, the metal roof including a series of corrugated metal roof panels extending upwardly toward a central peak, each corrugated metal roof panel having a plurality of raised ribs and a plurality of trough-like valleys, the plurality of ribs of each metal roof panel extending generally upwardly toward the central peak, the metal roof panels located closest to the central peak each having an uppermost end, and the uppermost ends of the metal roof panels located closest to the central peak on a first side of the central peak being spaced apart from the uppermost ends of the metal roof panels located closest to the central peak on an opposing second side of the central peak to form a ventilation gap, the vented closure comprising in combination:

a) a first U-shaped deck cap extending over and around the uppermost end of the metal roof panels located closest to the central peak on a first side of the central peak, the first deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the first deck cap having a first set of openings formed therein;

b) a second U-shaped deck cap extending over and around the uppermost end of the metal roof panels located closest to the central peak on the second side of the central peak, the second deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the second deck cap having a second set of openings formed therein;

c) a ridge cap extending along the central peak and above the ventilation gap, the ridge cap having a first side flange extending along one side thereof, and having a second side flange extending along an opposing second side thereof, the first side flange engaging the top panel of the first deck cap at a point beyond the first set of openings relative to the central peak, the second side flange engaging the top panel of the second deck cap at a point beyond the second set of openings relative to the central peak, and d) fasteners securing the first side flange of the ridge cap and the top panel of the first deck cap to ribs of metal roof panels therebelow, and securing the second side flange of the ridge cap and the top panel of the second deck cap to ribs of metal roof panels therebelow;

e) whereby the ridge cap closes the ventilation gap from above, and wherein air may pass upwardly through the ventilation gap, downwardly through the first and second sets of openings, and outwardly through the plurality of trough-like valleys in the metal roof panels to the exterior of the building.

2. The vented closure recited by claim 1 wherein the first set of openings formed in the top panel of the first deck cap are slotted louvers, and wherein the second set of openings formed in the top panel of the second deck cap are slotted louvers.

3. The vented closure recited by claim 2 wherein the slotted louvers within the top panels of the first and second deck caps are arranged in a plurality of rows, and wherein the slotted louvers in one row are staggered relative to the slotted louvers in an adjacent row.

4. The vented closure recited by claim 1 including sealing material proximate the central panel of each deck cap, and proximate the uppermost end of each metal roof panel engaged with said deck cap, for sealing the central panel of each deck cap to the uppermost ends of each metal roof panel engaged therewith.

5. The vented closure recited by claim 4 wherein said sealing material is caulk.

6. The vented closure recited by claim 4 wherein said sealing material is a layer of elastomeric material interposed between the central panel of each deck cap and the uppermost ends of the metal roof panels engaged with said deck cap.

7. The vented closure recited by claim 6 wherein said elastomeric material is a closed cell foam tape adhered to the central panel of each deck cap.

8. The vented closure recited by claim 1 wherein the first and second side flanges of said ridge cap include inwardly-turned lips to extend around and below the top panels of the deck caps with which said ridge cap is engaged.

9. A vented closure for a metal roof of a building, the metal roof including a series of corrugated metal roof panels extending upwardly toward a central peak, each corrugated metal roof panel having a plurality of raised ribs and a plurality of trough-like valleys, the plurality of ribs of each metal roof panel extending generally upwardly toward the central peak, the metal roof panels located closest to the central peak each having an uppermost end, and the uppermost ends of the metal roof panels located closest to the central peak on a first side of the central peak being spaced apart from the uppermost ends of the metal roof panels located closest to the central peak on an opposing second side of the central peak to form a ventilation gap, the vented closure comprising in combination:

a) a first U-shaped deck cap extending over and around the uppermost end of the metal roof panels located closest to the central peak on a first side of the central peak, the first deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the first deck cap having a first set of openings formed therein;

b) a second U-shaped deck cap extending over and around the uppermost end of the metal roof panels located closest to the central peak on the second side of the central peak, the second deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the second deck cap having a second set of openings formed therein;

c) fasteners securing the top panel of the first deck cap to ribs of metal roof panels therebelow, and securing the top panel of the second deck cap to ribs of metal roof panels therebelow;

d) a ridge cap extending along the central peak and above the ventilation gap, the ridge cap having a first side flange extending along one side thereof, and having a second side flange extending along an opposing second side thereof, the first side flange engaging the top panel of the first deck cap at a point beyond the first set of openings relative to the central peak, the first side flange including an inwardly-turned lip to extend around and below the top panel of the deck caps with which said first side flange is engaged, the second side flange engaging the top panel of the second deck cap at a point beyond the second set of openings relative to the central peak, the second side flange including an inwardly-turned lip to extend around and below the top panel of the deck caps with which said second side flange is engaged;

e) whereby the ridge cap closes the ventilation gap from above, and wherein air may pass upwardly through the ventilation gap, downwardly through the first and second sets of openings, and outwardly through the plurality of trough-like valleys in the metal roof panels to the exterior of the building.

10. The vented closure recited by claim 9 wherein the first set of openings formed in the top panel of the first deck cap are slotted louvers, and wherein the second set of openings formed in the top panel of the second deck cap are slotted louvers.

11. The vented closure recited by claim 10 wherein the slotted louvers within the top panels of the first and second deck caps are arranged in a plurality of rows, and wherein the slotted louvers in one row are staggered relative to the slotted louvers in an adjacent row.

12. The vented closure recited by claim 9 including sealing material proximate the central panel of each deck cap, and proximate the uppermost end of each metal roof panel engaged with said deck cap, for sealing the central panel of each deck cap to the uppermost ends of each metal roof panel engaged therewith.

13. The vented closure recited by claim 12 wherein said sealing material is caulk.

14. The vented closure recited by claim 12 wherein said sealing material is a layer of elastomeric material interposed between the central panel of each deck cap and the uppermost ends of the metal roof panels engaged with said deck cap.

15. The vented closure recited by claim 14 wherein said elastomeric material is a close cell foam tape adhered to the central panel of each deck cap.

16. A vented metal roof structure for a building comprising in combination:

a) a first plurality of corrugated metal roof panels extending upwardly toward a central peak on one side of the central peak, each of said first plurality of metal roof panels having a plurality of raised ribs and a plurality of trough-like valleys, the plurality of ribs of each of said first plurality of metal roof panel extending generally upwardly toward the central peak, the metal roof panels located closest to the central peak each having an uppermost end;

b) a second plurality of corrugated metal roof panels extending upwardly toward the central peak on a second opposing side of the central peak, each of said second plurality of metal roof panels having a plurality of raised ribs and a plurality of trough-like valleys, the plurality of ribs of each of said second plurality of metal roof panels extending generally upwardly toward the central peak, the metal roof panels located closest to the central peak each having an uppermost end;

c) a first U-shaped deck cap extending over and around the uppermost end of the first plurality of metal roof panels located closest to the central peak, the first deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the first deck cap having a first set of openings formed therein;

d) a second U-shaped deck cap extending over and around the uppermost end of the second plurality of metal roof panels located closest to the central peak, the second deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the second deck cap having a second set of openings formed therein;

e) a ridge cap extending along the central peak and above the ventilation gap, the ridge cap having a first side flange extending along one side thereof, and having a second side flange extending along an opposing second side thereof, the first side flange engaging the top panel of the first deck cap at a point beyond the first set of openings relative to the central peak, the second side flange engaging the top panel of the second deck cap at a point beyond the second set of openings relative to the central peak, and d) fasteners securing the first side flange of the ridge cap and the top panel of the first deck cap to ribs of the first plurality of metal roof panels therebelow, and securing the second side flange of the ridge cap and the top panel of the second deck cap to ribs of the second plurality of metal roof panels therebelow;

e) whereby the ridge cap closes the ventilation gap from above, and wherein air may pass upwardly through the ventilation gap, downwardly through the first and second sets of openings, and outwardly through the plurality of trough-like valleys in the metal roof panels to the exterior of the building.

17. The vented closure recited by claim 16 wherein the first set of openings formed in the top panel of the first deck cap are slotted louvers, and wherein the second set of openings formed in the top panel of the second deck cap are slotted louvers.

18. The vented closure recited by claim 17 wherein the slotted louvers within the top panels of the first and second deck caps are arranged in a plurality of rows, and wherein the slotted louvers in one row are staggered relative to the slotted louvers in an adjacent row.

19. The vented metal roof structure recited by claim 16 including sealing material proximate the central panel of each deck cap, and proximate the uppermost end of each metal roof panel engaged with said deck cap, for sealing the central panel of each deck cap to the uppermost ends of each metal roof panel engaged therewith.

20. The vented metal roof structure recited by claim 19 wherein said sealing material is a layer of elastomeric material interposed between the central panel of each deck cap and the uppermost ends of the metal roof panels engaged with said deck cap.

21. The vented closure recited by claim 20 wherein said elastomeric material is a closed cell foam tape adhered to the central panel of each deck cap.

22. A vented metal roof structure for a building comprising in combination:

a) a first plurality of corrugated metal roof panels extending upwardly toward a central peak on one side of the central peak, each of said first plurality of metal roof panels having a plurality of raised ribs and a plurality of trough-like valleys, the plurality of ribs of each of said first plurality of metal roof panel extending generally upwardly toward the central peak, the metal roof panels located closest to the central peak each having an uppermost end;

b) a second plurality of corrugated metal roof panels extending upwardly toward the central peak on a second opposing side of the central peak, each of said second plurality of metal roof panels having a plurality of raised ribs and a plurality of trough-like valleys, the plurality of ribs of each of said second plurality of metal roof panels extending generally upwardly toward the central peak, the metal roof panels located closest to the central peak each having an uppermost end;

c) a first U-shaped deck cap extending over and around the uppermost end of the first plurality of metal roof panels located closest to the central peak, the first deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the first deck cap having a first set of openings formed therein;

d) a second U-shaped deck cap extending over and around the uppermost end of the second plurality of metal roof panels located closest to the central peak, the second deck cap including a top panel for extending over the uppermost end of said metal roof panels, a bottom panel for extending under the uppermost end of said metal roof panels, and a central panel connecting the top and bottom panels to each other and for closing the trough-like valleys of said metal roof panels proximate the central peak, the top panel of the second deck cap having a second set of openings formed therein;

c) fasteners securing the top panel of the first deck cap to ribs of metal roof panels therebelow, and securing the top panel of the second deck cap to ribs of metal roof panels therebelow;

d) a ridge cap extending along the central peak and above the ventilation gap, the ridge cap having a first side flange extending along one side thereof, and having a second side flange extending along an opposing second side thereof, the first side flange engaging the top panel of the first deck cap at a point beyond the first set of openings relative to the central peak, the first side flange including an inwardly-turned lip to extend around and below the top panel of the deck caps with which said first side flange is engaged, the second side flange engaging the top panel of the second deck cap at a point beyond the second set of openings relative to the central peak, the second side flange including an inwardly-turned lip to extend around and below the top panel of the deck caps with which said second side flange is engaged;

e) whereby the ridge cap closes the ventilation gap from above, and wherein air may pass upwardly through the ventilation gap, downwardly through the first and second sets of openings, and outwardly through the plurality of trough-like valleys in the metal roof panels to the exterior of the building.

23. The vented closure recited by claim 22 wherein the first set of openings formed in the top panel of the first deck cap are slotted louvers, and wherein the second set of openings formed in the top panel of the second deck cap are slotted louvers.

24. The vented closure recited by claim 23 wherein the slotted louvers within the top panels of the first and second deck caps are arranged in a plurality of rows, and wherein the slotted louvers in one row are staggered relative to the slotted louvers in an adjacent row.

25. The vented metal roof structure recited by claim 22 including sealing material proximate the central panel of each deck cap, and proximate the uppermost end of each metal roof panel engaged with said deck cap, for sealing the central panel of each deck cap to the uppermost ends of each metal roof panel engaged therewith.

26. The vented metal roof structure recited by claim 25 wherein said sealing material is a layer of elastomeric material interposed between the central panel of each deck cap and the uppermost ends of the metal roof panels engaged with said deck cap.

27. The vented closure recited by claim 26 wherein said elastomeric material is a closed cell foam tape adhered to the central panel of each deck cap.

* * * * *